US009523492B2

(12) United States Patent
Ha et al.

(10) Patent No.: US 9,523,492 B2
(45) Date of Patent: Dec. 20, 2016

(54) LIGHTING APPARATUS

(71) Applicant: LG ELECTRONICS INC., Seoul (KR)

(72) Inventors: Jeongseok Ha, Seoul (KR); Yongjin Kim, Seoul (KR); Jongkyo Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 24 days.

(21) Appl. No.: 14/570,977

(22) Filed: Dec. 15, 2014

(65) Prior Publication Data

US 2015/0167954 A1 Jun. 18, 2015

(30) Foreign Application Priority Data

Dec. 17, 2013 (KR) ..... 10-2013-0157318

(51) Int. Cl.

| | |
|---|---|
| ***F21V 29/00*** | (2015.01) |
| ***F21V 29/75*** | (2015.01) |
| ***F21V 29/83*** | (2015.01) |
| *F21Y 101/00* | (2016.01) |

(52) U.S. Cl.

CPC ..... *F21V 29/75* (2015.01); *F21V 29/83* (2015.01); *F21Y 2101/00* (2013.01)

(58) Field of Classification Search

CPC ..... F21V 29/70; F21V 29/75

See application file for complete search history.

(56) References Cited

U.S. PATENT DOCUMENTS

| | | | | |
|---|---|---|---|---|
| 7,575,346 | B1 * | 8/2009 | Horng | F21V 29/02 362/294 |
| 8,319,408 | B1 * | 11/2012 | Horng | F21K 9/135 313/46 |
| 8,541,932 | B2 * | 9/2013 | Horng | F21V 29/02 313/35 |
| 8,610,339 | B2 * | 12/2013 | Fang | F21V 29/02 313/35 |
| 8,920,000 | B2 * | 12/2014 | Horng | F21K 9/13 313/35 |
| 2009/0251898 | A1 * | 10/2009 | Kinnune | F21V 15/015 362/249.02 |
| 2010/0020492 | A1 * | 1/2010 | Luo | F21V 15/01 361/693 |

(Continued)

FOREIGN PATENT DOCUMENTS

| | | | |
|---|---|---|---|
| EP | 2 312 202 | A1 | 4/2011 |
| JP | 2011-86621 | A | 4/2011 |

(Continued)

*Primary Examiner* — Elmito Breval

(74) *Attorney, Agent, or Firm* — Birch, Stewart, Kolasch & Birch, LLP

(57) ABSTRACT

Disclosed is a lighting apparatus. The lighting apparatus includes a light emitting unit including a light emitting diode (LED), a heat sink including a first face, the light emitting unit being disposed on the first face, a second face opposite to the first face, and a space having a prescribed volume between the first face and the second face, and a power source unit configured to supply power to the light emitting unit. The second face is provided with a flow hole to open a region of the space, and the second face includes a plurality of curved portions arranged in a height direction of the heat sink, the curved portions having different radii of curvature.

14 Claims, 9 Drawing Sheets
(4 of 9 Drawing Sheet(s) Filed in Color)

(56) References Cited

U.S. PATENT DOCUMENTS

| | | | | |
|---|---|---|---|---|
| 2010/0020537 | A1* | 1/2010 | He | F21K 9/137 362/234 |
| 2010/0232155 | A1* | 9/2010 | Wang | F21S 2/005 362/235 |
| 2011/0044043 | A1* | 2/2011 | Wong | F21V 29/004 362/249.02 |
| 2012/0146481 | A1* | 6/2012 | Li | F21K 9/13 313/46 |
| 2013/0294094 | A1* | 11/2013 | Horng | F21V 29/02 362/373 |
| 2014/0211478 | A1* | 7/2014 | Park | F21V 29/02 362/294 |

FOREIGN PATENT DOCUMENTS

| | | | |
|---|---|---|---|
| KR | 20-2009-0008907 | U | 9/2009 |
| KR | 10-2011-0051071 | A | 5/2011 |
| KR | 10-2011-0131385 | A | 12/2011 |
| KR | 10-1113292 | B1 | 2/2012 |
| KR | 10-2012-0080459 | A | 7/2012 |
| KR | 10-2012-0128944 | A | 11/2012 |
| KR | 10-2013-0075025 | A | 7/2013 |
| KR | 10-2013-0123574 | A | 11/2013 |

* cited by examiner (a)

(b)

(c)

(d)

(e)

(f)

LIGHTING APPARATUS

This application claims the benefit of Korean Patent Application No. 10-2013-0157318, filed on, Dec. 17, 2013, which is hereby incorporated by reference as if fully set forth herein.

BACKGROUND OF THE INVENTION

Field of the Invention

The present invention relates to lighting apparatuses and, more particularly, to lighting apparatuses capable of enhancing radiation performance.

Discussion of the Related Art

Generally, examples of light sources mainly used in luminaires include incandescent bulbs, discharge lamps, and fluorescent lamps. These light sources are used for multiple purposes, such as residential use, industrial use, landscaping, etc.

Thereamong, resistive light sources, such as incandescent bulbs, may suffer from low efficiency and considerable heat emission, discharge lamps may suffer from high price and high voltage, and fluorescent lamps may suffer from environmental contamination due to use of mercury.

To solve these disadvantages of the aforementioned light sources, interest in Light Emitting Diode (hereinafter referred to as LED) lightings is increasing owing to many advantages thereof including high efficiency, color diversity, free design, and the like.

LEDs are semiconductor devices that emit light when voltage is applied thereto and have low power consumption and electrical, optical and physical properties suitable for mass production. Accordingly, LEDs are rapidly replacing incandescent bulbs and fluorescent lamps. In addition, LEDs are incrementally applied to outdoor lighting apparatuses, such as streetlamps, security lights, and the like.

Meanwhile, LED lighting apparatuses require a structure to effectively radiate heat generated from LEDs. Failure in outward radiation of heat from LEDs causes deterioration in the efficiency of lighting apparatuses.

SUMMARY OF THE INVENTION

Accordingly, the present invention is directed to lighting apparatuses that substantially obviate one or more problems due to limitations and disadvantages of the related art.

One object of the present invention is to provide lighting apparatuses capable of improving radiation performance.

Another object of the present invention is to provide lighting apparatuses capable of successively varying convection heat exchange of outside air while the outside air passes through a heat sink.

A further object of the present invention is to provide lighting apparatuses capable of guiding flow of outside air via the Coanda effect.

Additional advantages, objects, and features will be set forth in part in the description which follows and in part will become apparent to those having ordinary skill in the art upon examination of the following or may be learned from practice. The objectives and other advantages may be realized and attained by the structure particularly pointed out in the written description and claims hereof as well as the appended drawings.

To achieve these objects and other advantages and in accordance with the purpose of the invention, as embodied and broadly described herein, in accordance with an aspect of the present invention, a lighting apparatus includes a light emitting unit including a light emitting diode (LED), a heat sink including a first face, the light emitting unit being disposed on the first face, a second face opposite to the first face, and a space having a prescribed volume between the first face and the second face, and a power source unit configured to supply power to the light emitting unit.

Here, the second face is provided with a flow hole to open a region of the space, and the second face includes a plurality of curved portions arranged in a height direction of the heat sink, the curved portions having different radii of curvature.

In addition, the second face may include a first curved portion and a second curved portion arranged in sequence with increasing distance from the first face and decreasing distance to the flow hole, the first curved portion and the second curved portion having different radii of curvature, and the radius of curvature of the first curved portion may be less than the radius of curvature of the second curved portion.

In addition, the first curved portion and the second curved portion may have centers of curvature respectively located at different regions divided on the basis of the second face.

In addition, the first curved portion may have a shorter arcuate length than an arcuate length of the second curved portion.

In addition, air of the space may flow outward through the flow hole during operation of the light emitting unit, outside air may flow to the flow hole along the second face, and the outside air may increase in flow velocity while passing the first curved portion and be reduced in flow velocity while passing the second curved portion.

The flow hole may be configured to extend over a length of the entire second face, and either longitudinal end of the second face is opened by the flow hole.

It is to be understood that both the foregoing general description and the following detailed description of the present invention are exemplary and explanatory and are intended to provide further explanation of the present invention as claimed.

BRIEF DESCRIPTION OF THE DRAWINGS

The patent or application file contains at least one color drawing. Copies of this patent or patent application publication with color drawing will be provided by the USPTO upon request and payment of the necessary fee.

The accompanying drawings, which are included to provide a further understanding of the present invention and are incorporated in and constitute a part of this application, illustrate embodiment(s) of the present invention and together with the description serve to explain the principle of the present invention. In the drawings.

DETAILED DESCRIPTION OF THE INVENTION

Hereinafter, a lighting apparatus according to one embodiment of the present invention will be described below with reference to the accompanying drawings. The accompanying drawings are provided to exemplify the present invention and to assist a detailed description of the present invention, and a technical scope of the present invention is not limited to the drawings.

Figure 1:
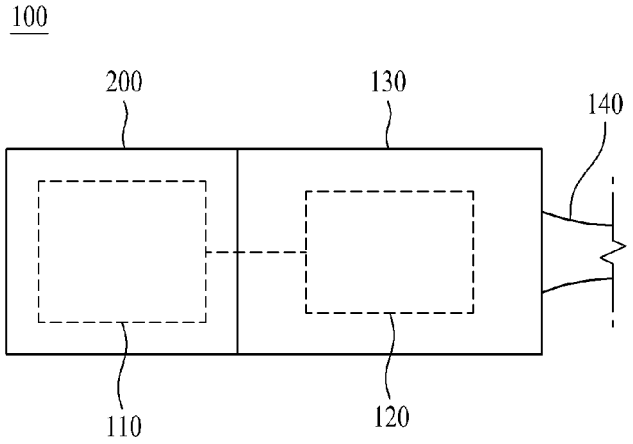
FIG. 1 is a view illustrating the concept of a lighting apparatus according to a first embodiment of the present invention.

FIG. 1 is a view illustrating the concept of a lighting apparatus 100 according to a first embodiment of the present invention.

The lighting apparatus 100 according to the present invention may be embodied as an outdoor lighting apparatus, such as a streetlamp, etc., as well as an indoor lighting apparatus.

The lighting apparatus 100 includes a light emitting unit 110, a heat sink 200, and a power source unit 120.

The light emitting unit 110 may include LEDs as a light source. The light emitting unit 110 may include a circuit board (see 111 of FIG. 3) and one or more LEDs (see 112 of FIG. 3) mounted on the circuit board 111.

The circuit board 111 may be formed of a metal material having high thermal conductivity. In addition, the light emitting unit 110 may further include an optical cover (not shown) surrounding the LEDs 112.

The power source unit 120 is electrically connected to the light emitting unit 110. The power source unit 120 supplies power to the light emitting unit 110.

In addition, the power source unit 120 includes a controller to adjust brightness, color temperature, and the like of the light emitting unit 110. The power source unit 120 may include a converter to convert external commercial power into direct current (DC) power.

Meanwhile, the light emitting unit 110 may be mounted to the heat sink 200. Specifically, the light emitting unit 110 may be disposed on one face of the heat sink 200.

The heat sink 200 functions to outwardly radiate heat generated from the light emitting unit 110. The heat sink 200 may be formed of a metal material having high thermal conductivity.

Meanwhile, the lighting apparatus 100 may include a housing 130 configured to surround the power source unit 120. The housing 130 may be mounted to the heat sink 200.

More specifically, the housing 130 and the heat sink 200 may define an outer appearance of the lighting apparatus 100. The housing 130 and the heat sink 200 may be formed of the same material.

In one embodiment, the heat sink 200 and the housing 130 may be formed of the same metal. Alternatively, the heat sink 200 may be formed of a metal material and the housing 130 may be formed of a resin material.

In this case, the light emitting unit 110 may be disposed on the heat sink 200, and the power source unit 120 may be placed in the housing 130. In addition, the light emitting unit 110 and the power source unit 120 may be electrically connected to each other via, for example, a cable.

In this case, a portion of the cable may be located within the housing 130 and the remaining portion of the cable may be located within the heat sink 200.

When the lighting apparatus 100 is an outdoor lighting apparatus, the lighting apparatus 100 may further include a support member 140. The support member 140 may be connected to the housing 130.

In addition, the support member 140 may have a "¬"-shaped form or a "|"-shaped form. In one embodiment, the support member 140 may include a pole fixed to an installation plane and an arm connected to the housing 130.

Hereinafter, a configuration of the heat sink 200 will be described in detail with reference to the accompanying drawings.

Figure 2:
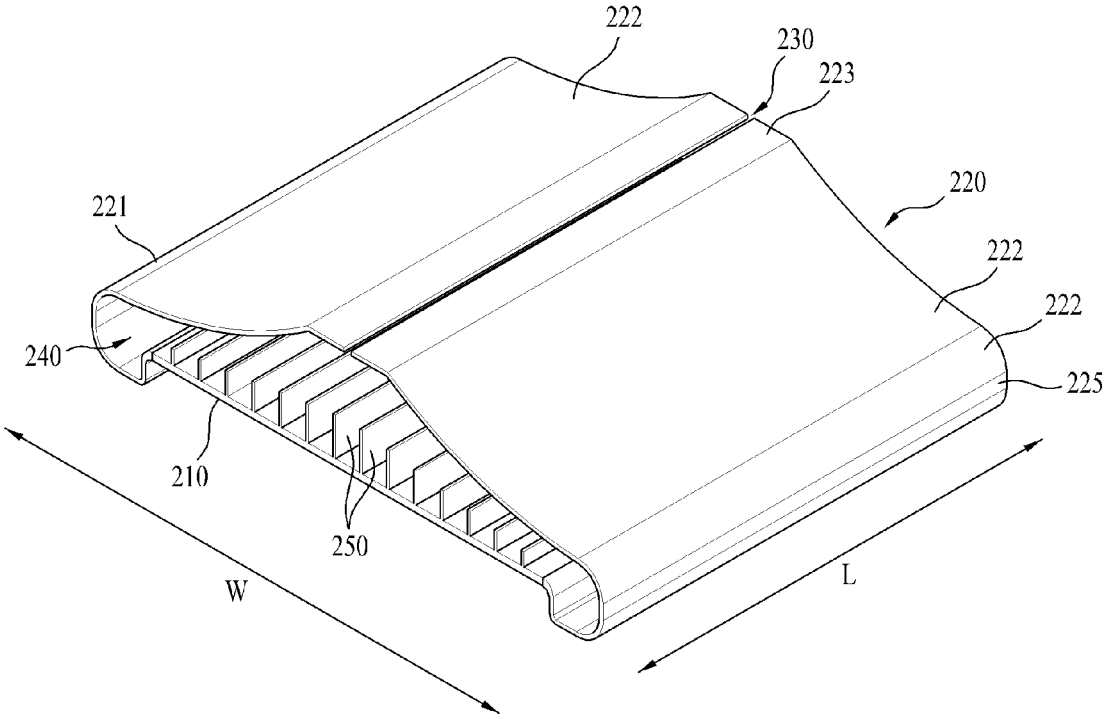
FIG. 2 is a perspective view of a heat sink included in the lighting apparatus according to the first embodiment of the present invention.
Figure 3:
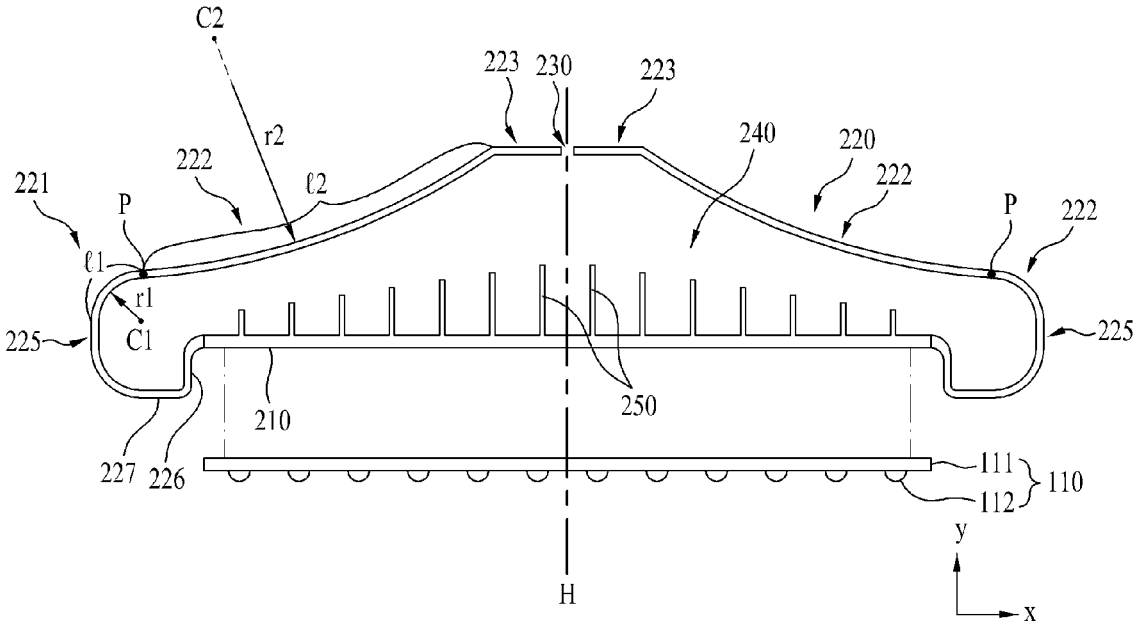
FIG. 3 is a front view of the heat sink shown in FIG. 2.

FIG. 2 is a perspective view of the heat sink 200 included in the lighting apparatus according to the first embodiment of the present invention, and FIG. 3 is a front view of the heat sink 200 shown in FIG. 2.

The heat sink 200 has a first face 210 on which the light emitting unit 110 is disposed and a second face 220 opposite to the first face 210. In addition, the heat sink 200 has a space 240 having a prescribed volume between the first face 210 and the second face 220.

Here, the first face 210 may be configured by a first member and the second face 220 may be configured by a second member. In addition, the first member and the second member may be integrated with each other to construct the heat sink 200.

The heat sink 200 is shaped to extend in a width direction W and in a longitudinal direction L. More specifically, the first face 210 and the second face 220 may be shaped to extend in the width direction W and the longitudinal direction L of the heat sink 200.

Meanwhile, the heat sink 200 and the housing 130 may be connected to each other in the longitudinal direction L of the heat sink 200.

In addition, the second face 220 is provided with a flow hole 230 to open a region of the space 240. The flow hole 230 may be elongated such that an extension length thereof in the longitudinal direction L is greater than an extension length thereof in the width direction W. Here, the flow hole 230 may be referred to as a flow slit.

The heat sink 200 may have a symmetrical shape about a center axis H of the heat sink 200. Referring to FIG. 3, the x-axis designates the width direction W of the heat sink 200 and the y-axis designates a height direction of the heat sink 200.

The center axis H is substantially parallel to the y-axis. Thus, the heat sink 200 may have a symmetrical shape on the basis of the height direction of the heat sink 200.

In this case, the center of the flow hole 230 and the center axis H may be coaxially located. In other words, the heat sink 200 may have a symmetrical shape on the basis of the flow hole 230.

Meanwhile, the second face 220 includes a plurality of curved portions 221 and 222 which have different radii of curvature r1 and r2 in the height direction of the heat sink 200.

The curved portions 221 and 222 having the different radii of curvature r1 and r2 may cause variation in the flow velocity of outside air flowing along the second face 220. As a result, convection heat exchange of the outside air flowing along the second face 220 may vary.

More specifically, the second face 220 may include first curved portions 221 and second curved portions 222 having different radii of curvature, the first and second curved portions 221 and 222 being arranged in sequence in a direction with increasing distance from the first face 210 and decreasing distance to the flow hole 230.

Here, the radius of curvature r1 of the first curved portions 221 may be less than the radius of curvature r2 of the second curved portions 222.

In addition, a center of curvature C1 of each first curved portion 221 and a center of curvature C2 of each second curved portion 222 may be located respectively at different regions divided on the basis of the second face 220. In one embodiment, the first curved portions 221 may be convex along the y-axis. In addition, the second curved portions 222 may be concave along the y-axis.

In addition, an arcuate length l 1 of the first curved portion 221 may be less than an arcuate length l 2 of the second curved portion 222.

In addition, an inflection point P on a boundary between the first curved portion 221 and the second curved portion 222 may be positioned so as not to overlap the light emitting unit 110 in the height direction of the heat sink 200.

More specifically, both inflection points P may be deviated respectively to both ends of the heat sink 200 in the width direction W. In addition, the first curved portions 221 may be positioned so as not to overlap the light emitting unit 110 in the height direction of the heat sink 200.

In addition, a planar portion 223 (also referred to as a "first horizontal portion") may be provided between each second curved portion 222 and the flow hole 230. In this case, the planar portion 223 may be parallel to the first face 210.

In addition, a vertical portion 225 (also referred to as a "first vertical portion") perpendicular to the first face 210 may be provided between the first face 210 and each first curved portion 221. In addition, a connection portion may be provided between the vertical portion 225 and the first face 210.

Here, the connection portion may include a vertical portion 226 (also referred to as a "second vertical portion") and a horizontal portion 227 (also referred to as a "second horizontal portion"). In addition, the connection portion may be provided with a flow slit in communication with the space 240.

A boundary between the second vertical portion 226 and the first face 210 may be rounded. Likewise, a boundary between the second vertical portion 226 and the second horizontal portion 227 may be rounded. In addition, a boundary between the second horizontal portion 227 and the first vertical portion 225 may be rounded.

Meanwhile, a plurality of radiation fins 250 having a prescribed height may be placed in the space 240. The radiation fins 250 may be spaced apart from one another by a prescribed distance.

The light emitting unit 110 may be disposed at an outer circumferential surface of the first member, and the radiation fins 250 may be arranged at an inner circumferential surface of the first member.

In addition, the radiation fins 250 may be positioned so as to overlap the light emitting unit 110 in the height direction of the heat sink 200.

In addition, the height of the respective radiation fins 250 may be gradually reduced with increasing distance from the flow hole 230.

Figure 4:
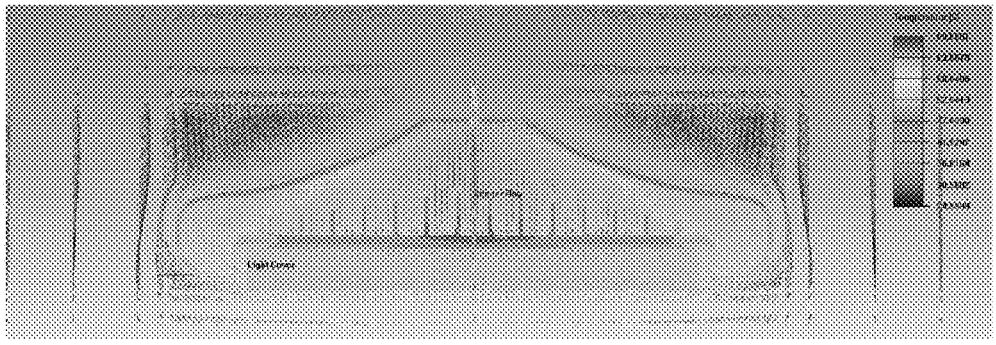
FIGS. 4 and 5 are views illustrating simulation results in relation to radiation of the heat sink shown in FIG. 2.
Figure 5:
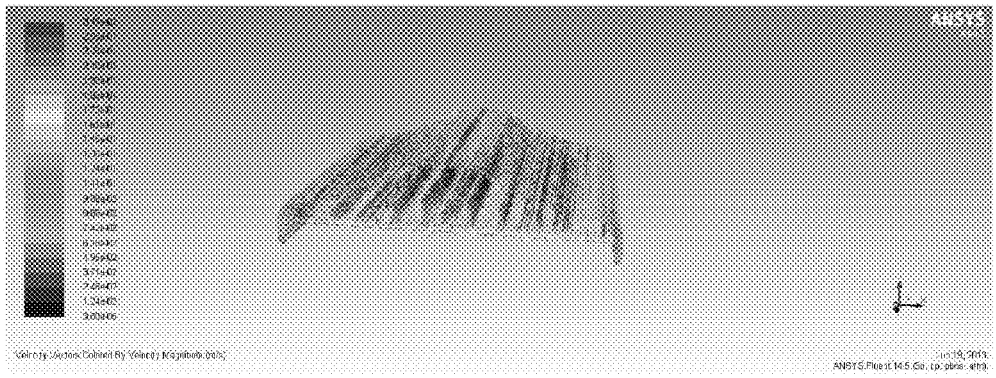

FIGS. 4 and 5 are views illustrating simulation results in relation to radiation of the heat sink 200 shown in FIG. 2.

Referring to FIGS. 4 and 5, during operation of the light emitting unit 110, interior air of the space 240 may flow outward through the flow hole 230. In this case, the flow of air out of the space 240 through the flow hole 230 may be referred to as primary flow (upward flow).

In addition, outside air may flow to the flow hole 230 along the second face 220. In this case, the flow of outside air along the second face 220 may be referred to as secondary flow. In addition, the secondary flow may be generated or accelerated by the primary flow.

In addition, the outside air may increase in flow velocity while passing the first curved portion 221, and may be reduced in flow velocity while passing the second curved portion 222. In particular, the Coanda effect occurs as the outside air passes the first curved portion 221.

The Coanda effect refers to a phenomenon in which fluid flows in a bent path when the fluid meets a bent object.

Referring to FIG. 4, during operation of the light emitting unit 110, the first face 210 and the space 240 undergo temperature increase. In this case, primary flow occurs due to a temperature difference between a high temperature region and a low temperature region. Then, the primary flow may generate or accelerate the aforementioned secondary flow.

In addition, the primary flow may function as a drive source for the secondary flow. Through the primary flow and the secondary flow, heat generated in the light emitting unit 110 may be easily radiated outward.

Referring to FIG. 5, a red region represents a region in which fluid flows at the highest velocity. That is, the flow velocity of air becomes the highest near the flow hole 230. In addition, green regions represent the first curved portions 221. The green regions are regions in which the flow velocity of air is accelerated and is related to the Coanda effect as described above.

Figure 6:
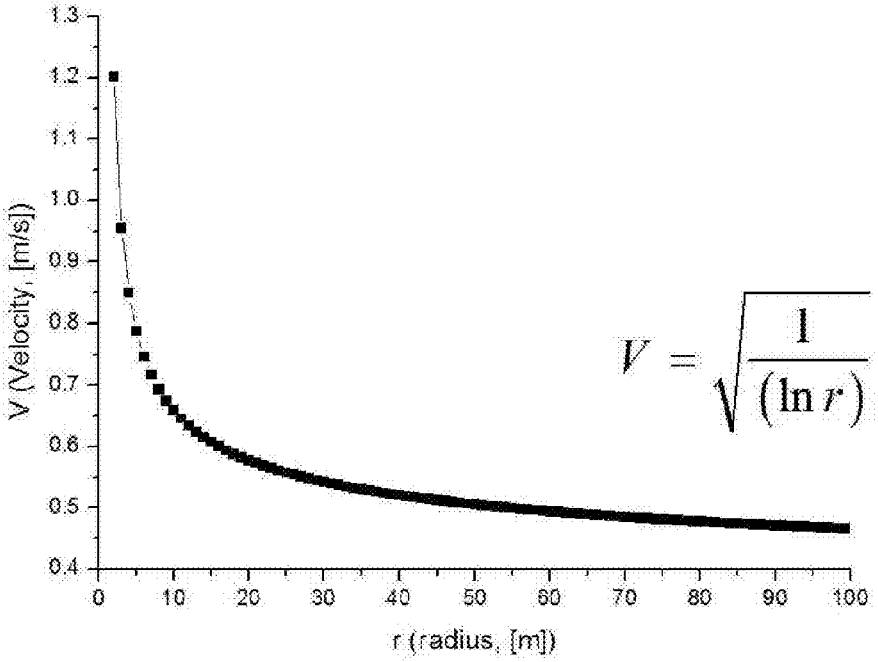
FIG. 6 is a graph illustrating a relationship between a radius of curvature and a flow velocity of outside air.

FIG. 6 is a graph illustrating a relationship between a radius of curvature r and a flow velocity of outside air V. As described above, increase and reduction in the flow velocity of outside air flowing along the second face 220 of the heat sink 200 are related to radii of curvature of the curved portions 221 and 222.

$$\frac{\partial P}{\partial r} = \frac{\rho V^2}{r} \qquad \text{Equation 1}$$

$$V = \sqrt{\frac{P}{\rho(lnr)}} \qquad \text{Equation 2}$$

In the above Equation 1 and Equation 2, P is pressure, r is radius of curvature, and V is flow velocity.

Equation 1 is derived from Euler's formula and the Coanda effect may be confirmed from Equation 1. Integration with respect to "r" is possible based on the fact that movement of fluid is affected by geometrical elements and, hence, Equation 2 may be derived.

In this case, a relation function shown in FIG. 6 may be obtained assuming that P and p are constant.

Referring to FIG. 6, a flow velocity V of air passing a curved portion may vary as a radius of curvature r of the curved portion increases. That is, a greater radius of curvature r causes a less flow velocity V, whereas a les radius of curvature r causes a greater flow velocity V.

In addition, a convection heat exchange coefficient h increases as the flow velocity V increases.

Figure 7:
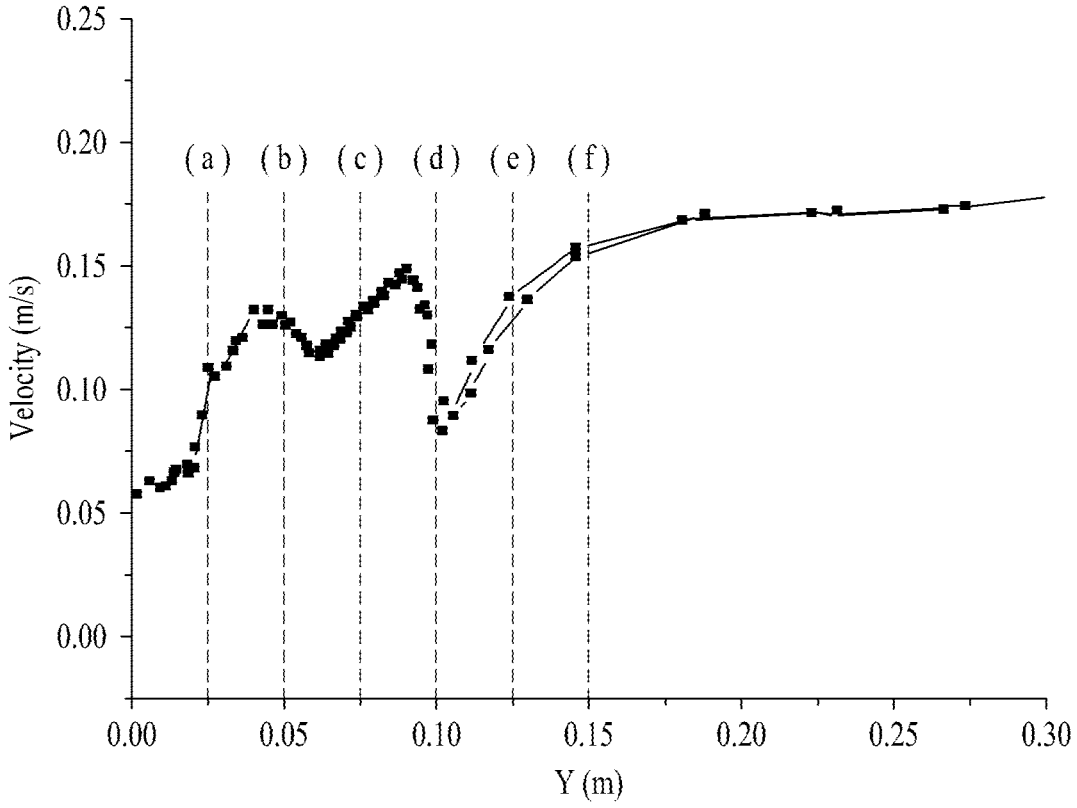
FIG. 7 is a graph illustrating velocity distribution of air flowing at the outside of the heat sink.
Figure 8:
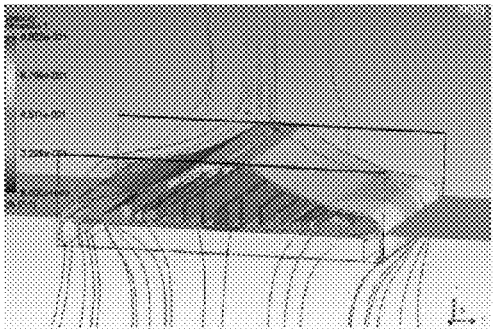
FIG. 8 is a view illustrating simulation results with respect to respective sections shown in FIG. 7.
Figure 8:
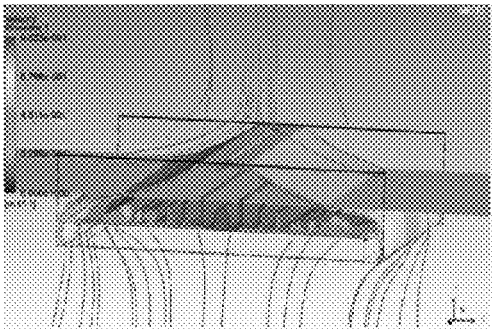
Figure 8:
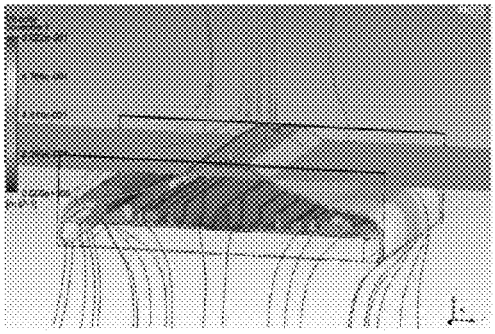
Figure 8:
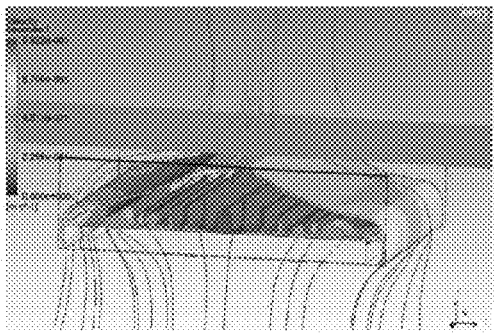
Figure 8:
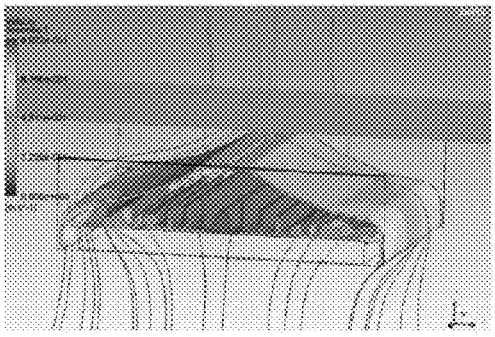
Figure 8:
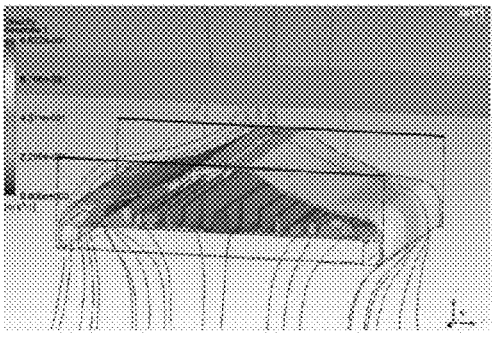

FIG. 7 is a graph illustrating velocity distribution of air flowing at the outside of the heat sink 200, and FIG. 8 is a view illustrating simulation results with respect to respective sections shown in FIG. 7.

Section (a) in FIG. 7 corresponds to simulation results of FIG. 8(*a*), and section (b) in FIG. 7 corresponds to simulation results of FIG. 8(*b*).

Likewise, section (c) in FIG. 7 corresponds to simulation results of FIG. 8(*c*), and section (d) in FIG. 7 corresponds to simulation results of FIG. 8(*d*). In addition, section (e) in FIG. 7 corresponds to simulation results of FIG. 8(*e*), and section (1) in FIG. 7 corresponds to simulation results of FIG. 8(*f*).

Referring to FIGS. 7 and 8, section (a) in FIG. 7 is related to the first curved portion 221. That is, there is provided an acceleration section in which the flow velocity of outside air increases while the outside air enters and passes the first curved portion 221.

In addition, section (b) is related to the second curved portion 222 proximate to the first curved portion 221.

More specifically, outside air moves from the first curved portion 221 to the second curved portion 222. In this case, the radius of curvature r2 of the second curved portion 222 is greater than the radius of curvature r1 of the first curved portion 221. Therefore, there is provided a deceleration section in which the flow velocity of outside air is reduced while the outside air enters and passes the second curved portion 222.

In addition, section (c) is related to the second curved portion 222 proximate to the flow hole 230.

In this case, the flow velocity of outside air increases by the above-described primary flow (center upward flow).

Finally, referring to section (d) to section (f) in FIG. 7, it can be confirmed that upward flow occurs and is accelerated and developed at the flow hole 230.

In short, the flow velocity of outside air increases while the outside air passes the first curved portion 221. Then, the flow velocity of outside air is reduced while the outside air passes the second curved portion 222 and, in turn, the flow velocity of outside air again increases at a boundary between the second curved portion 222 and the flow hole 230.

Figure 9:
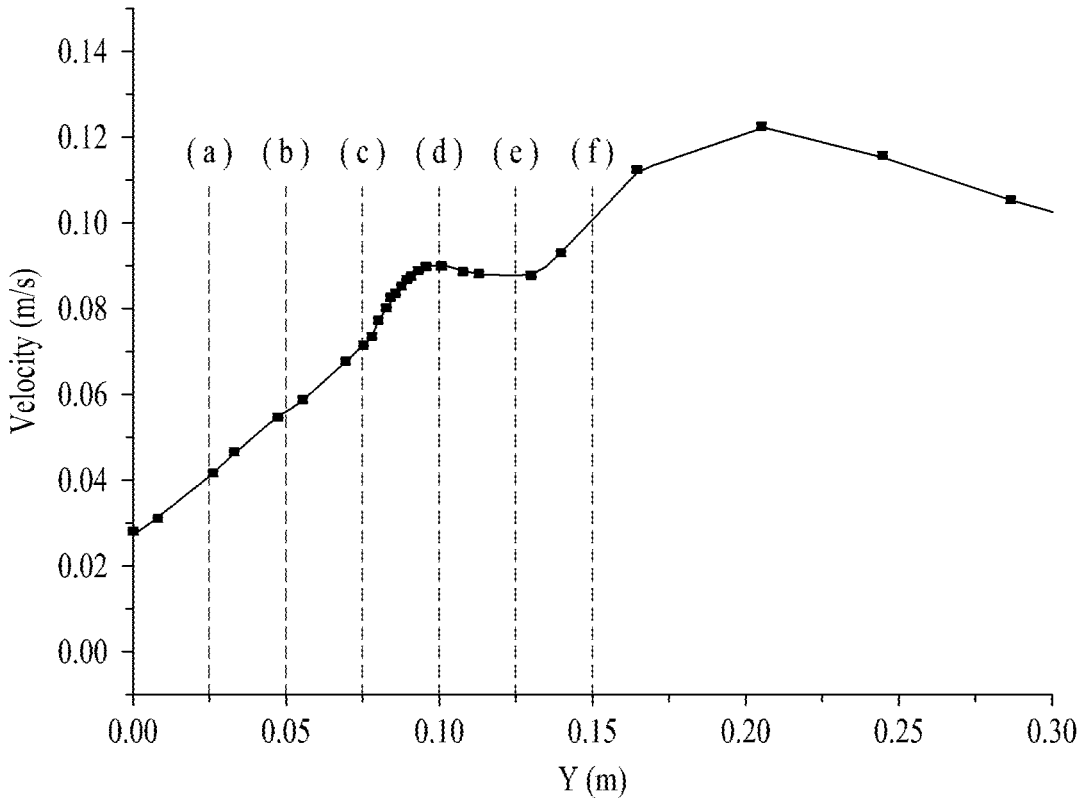
FIG. 9 is a graph illustrating velocity distribution of air flowing within the heat sink.
Figure 10:
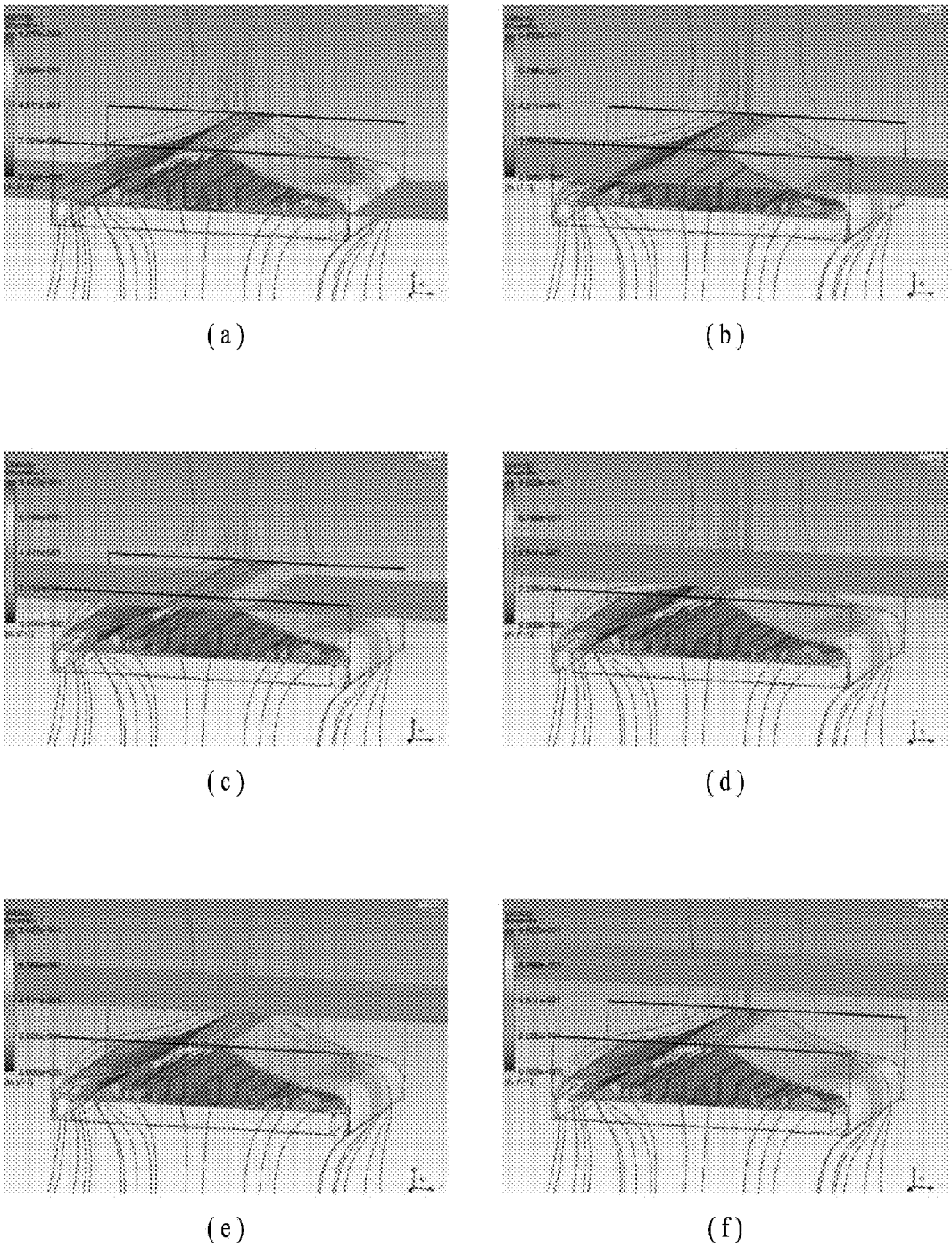
FIG. 10 is a graph illustrating simulation results with respect to respective sections shown in FIG. 9.

FIG. 9 is a graph illustrating velocity distribution of air flowing within the heat sink 200, and FIG. 10 is a graph illustrating simulation results with respect to respective sections shown in FIG. 9.

Section (a) in FIG. 9 corresponds to simulation results of FIG. 10(*a*), and section (b) in FIG. 9 corresponds to simulation results of FIG. 10(*b*).

Likewise, section (c) in FIG. 9 corresponds to simulation results of FIG. 10(*c*), and section (d) in FIG. 9 corresponds to simulation results of FIG. 10(*d*). In addition, section (e) in FIG. 9 corresponds to simulation results of FIG. 10(*e*), and section (f) in FIG. 9 corresponds to simulation results of FIG. 10(*f*).

Referring to sections (a) and (b) in FIG. 9, it can be confirmed that the flow velocity of air increases due to a curved shape of the second face 220.

In addition, referring to section (c) in FIG. 9, it can be confirmed that the flow velocity of air increases by primary flow.

In addition, referring to section (d) in FIG. 9, it can be confirmed that the flow velocity of air is reduced as the air is discharged through the flow hole 230.

Referring to sections (e) and (f) in FIG. 9, it can be confirmed that upward flow is accelerated and developed.

Figure 11:
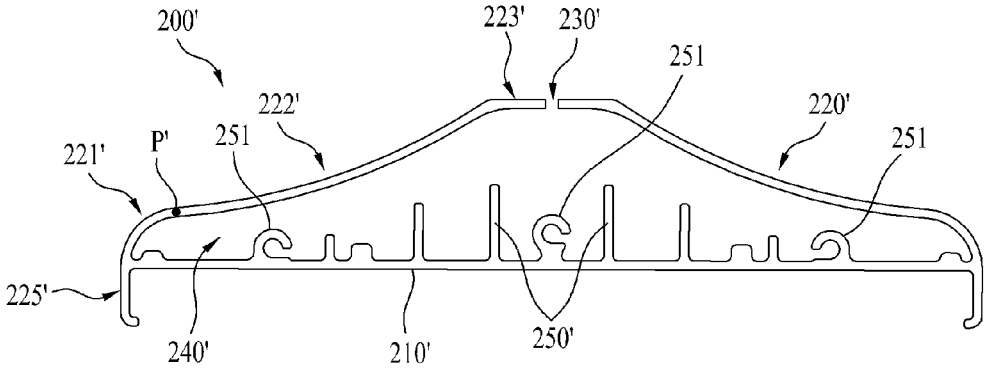
FIG. 11 is a front view of a heat sink included in the lighting apparatus according to a second embodiment of the present invention.

FIG. 11 is a front view of a heat sink 200' included in the lighting apparatus according to a second embodiment of the present invention.

Referring to FIG. 11, the heat sink 200' includes a first face 210' on which the light emitting unit is disposed and a second face 220' opposite to the first face 210'. In addition, the second face 220' includes first curved portions 221' and second curved portions 222'.

In addition, the second face 220' is provided with a flow hole 230'. In addition, a space 240' having a prescribed volume is defined between the first face 210' and the second face 220'.

The heat sink 200' has the following differences from the heat sink 200 described above with reference to FIGS. 2 and 3.

The first curved portions 221' extend from the first face 210'. More specifically, the first curved portions 221' directly extend from the first face 210'. As such, inflection points P' are positioned so as to overlap the light emitting unit in a height direction of the heat sink 200'.

In addition, at least one or more radiation fins 251 among a plurality of radiation fins 250' and 251 are provided with mounts for coupling with the above-described housing 130. In one embodiment, the radiation fins 251 having the mounts may have bent free ends. That is, the mount may define a prescribed mounting space as the free end is bent.

In addition, a first vertical portion 225' extends from a boundary between each first curved portion 221' and the first face 210'. In this case, the first vertical portion 225' and the first face 210' may define a space for installation of the light emitting unit.

Radii of curvature, centers of curvature, and arcuate lengths of the first curved portions 221' and the second curved portions 222' are identical to those of the above-described heat sink 200 and a detailed description thereof will be omitted below.

Figure 12:
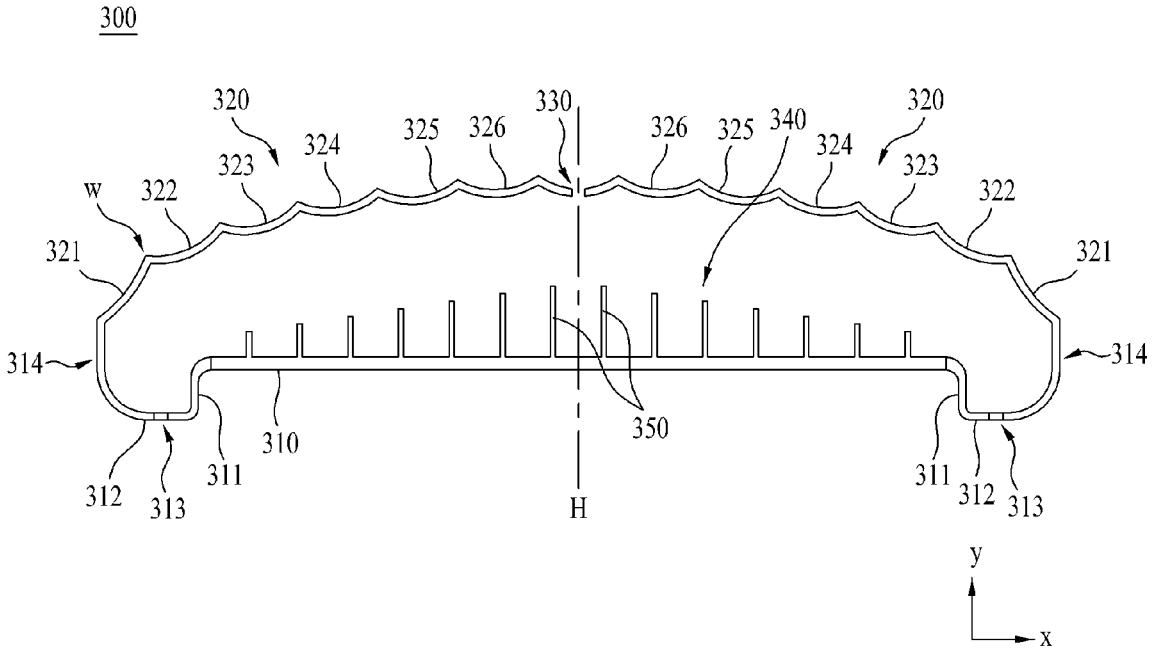
FIG. 12 is a front view of a heat sink included in the lighting apparatus according to a third embodiment of the present invention.
Figure 13:
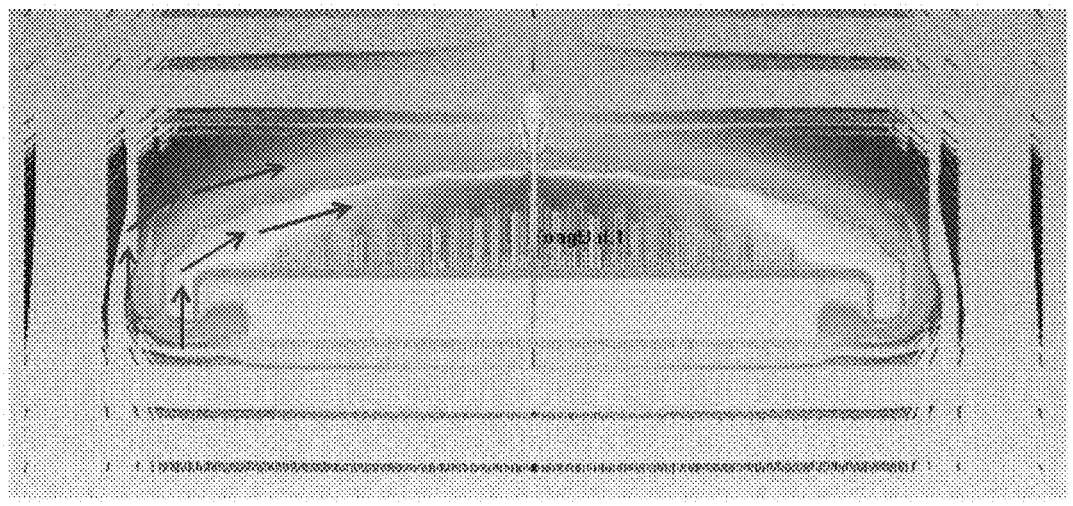
FIG. 13 is a view illustrating simulation results in relation to radiation of the heat sink shown in FIG. 12.

FIG. 12 is a front view of a heat sink 300 included in the lighting apparatus according to a third embodiment of the present invention, and FIG. 13 is a view illustrating simulation results in relation to radiation of the heat sink 300 shown in FIG. 12.

Referring to FIGS. 12 and 13, the heat sink 300, included in the lighting apparatus according to the third embodiment of the present invention, has a first face 310 on which the above-described light emitting unit 110 is disposed and a second face 320 opposite to the first face 310.

In addition, the heat sink 300 has a space 340 having a prescribed volume between the first face 310 and the second face 320.

In addition, the second face 320 is provided with a flow hole 330 to open a region of the space 340. The flow hole 330 functions to communicate the space 340 with the outside of the heat sink 300.

More specifically, interior air of the space 340 may be discharged outward through the flow hole 330, and outside air of the heat sink 300 may be introduced into the space 340 through the flow hole 330.

The heat sink 300 may have a symmetrical shape with respect to a center axis H of the heat sink 300. The x-axis designates a width direction W of the heat sink 300 and the y-axis designates a height direction of the heat sink 300. In this case, the center axis H is substantially parallel to the y-axis.

Accordingly, the heat sink 300 may have a symmetrical shape on the basis of the height direction of the heat sink 300. In addition, the center of the flow hole 330 and the center axis H may be coaxially located. In other words, the heat sink 300 may have a symmetrical shape on the basis of the flow hole 330.

However, note that the second face 320 of the heat sink 300 according to the third embodiment differs from the second face 220 of the heat sink 200 according to the first embodiment.

Hereinafter, differences between the heat sink 300 according to the third embodiment and the heat sink 200 according to the first embodiment will be described, and a detailed description of the same configurations as those of the first embodiment will be omitted.

The second face 320 is provided with a plurality of curved portions 321 to 326 having different radii of curvature in the height direction of the heat sink 300 (in the y-axis).

In this case, the curved portions 321 to 326 may be referred to as first to sixth curved portions 321 to 326 arranged in sequence with increasing distance from the first face 310 and decreasing distance to the flow hole 330 of the second face 320.

The curved portions 321 to 326 may be gradually reduced in the radius of curvature with increasing distance from the first face 310 and decreasing distance to the flow hole of the second face 320.

More specifically, the radius of curvature of the first curved portion 321 may be greater than the radius of curvature of the second curved portion 322. Likewise, the radius of curvature of the second curved portion 322 may be greater than the radius of curvature of the third curved portion 323.

When the curved portions 321 to 326 have different radii of curvature, the flow velocity of outside air flowing along the second face 320 may vary. As a result, convection heat exchange of the outside air flowing along the second face 320 may vary.

More specifically, when the radii of curvature of the corresponding curved portions are gradually reduced with decreasing distance to the flow hole 330, the air flowing along the second face 320 may be continuously accelerated.

In addition, the flow of outside air for radiation may not be easily released from the second face 320. That is, the Coanda effect as described above in the first embodiment may be expanded to the flow hole 330, which may result in increased radiation efficiency.

In addition, the center of curvature of each of the curved portions 321 to 326 may be located at the same region on the basis of the second face 320. In addition, the curved portions 321 to 326 may be concave along the y-axis.

Meanwhile, a distance between the centers of curvature of the respective two neighboring curved portions may be gradually reduced with increasing distance from the first face 310 and decreasing distance to the flow hole 330 of the second face 320.

In addition, a boundary between the respective two neighboring curved portions may have a wedge shape. The wedge shape may function to delay development of a boundary layer of outside air flowing along the second face 320.

The heat sink 330 may be provided with a connection portion between the first face 310 and the second face 320.

The connection portion may include first vertical portions 311 perpendicular to the first face 310, first horizontal portions 312 perpendicular to the first vertical portions 311, and second vertical portions 314 perpendicular to the first horizontal portions 312.

Here, a boundary between the first vertical portion 311 and the first horizontal portion 312 and a boundary between the first horizontal portion 312 and the second vertical portion 314 may be rounded respectively.

In addition, each first horizontal portion 312 may be provided with a flow slit 313. In this case, outside air may be introduced into the space 340 through the flow slit 313.

In addition, each second vertical portion 314 may be connected to the corresponding first curved portion 321.

Meanwhile, a plurality of radiation fins 350 having a prescribed height may be placed in the space 340. Heights of the respective radiation fins 350 may be gradually reduced with increasing distance from the flow hole 330.

Referring to FIG. 13, during operation of the light emitting unit, interior air of the space 340 may flow outward through the flow hole 330 (primary flow). As described above, outside air may flow to the flow hole 330 along the second face 320 (secondary flow). In this case, the secondary flow may be generated or accelerated by the primary flow.

In addition, the outside air may be accelerated while passing the curved portions 321 to 326. In addition, the Coanda effect occurs as the outside air flows along the second vertical portion 314 and the first curved portion 321. In this case, the Coanda effect may be expanded to the flow hole 330 due to the above-described shape of the second face 320.

As is apparent from the above description, a lighting apparatus in relation to one embodiment of the present invention has the following effects.

As outside air is directed to pass a plurality of curved portions having different radii of curvature while passing through a heat sink, successive variation in the flow velocity of outside air may be accomplished.

Specifically, increase or reduction in the flow velocity of outside air within a specific section may result in successive variation in convection heat exchange of outside air.

In addition, primary flow of outside air occurring within the heat sink may cause secondary flow of outside air at the outside of the heat sink.

In addition, the flow of outside air may be guided and radiation performance of the heat sink may be enhanced via the Coanda effect.

Although the exemplary embodiments have been illustrated and described as above, of course, it will be apparent to those skilled in the art that the present invention is not limited to the above described particular embodiments, and various modifications and variations can be made in the present invention without departing from the spirit or scope of the present invention, and the modifications and variations should not be understood individually from the viewpoint or scope of the present invention.

What is claimed is:

1. A lighting apparatus comprising:

a light emitting unit including a light emitting diode (LED);

a heat sink including a first face, the light emitting unit being disposed on the first face, a second face opposite to the first face, and a space having a prescribed volume between the first face and the second face; and a power source unit configured to supply power to the light emitting unit, wherein the second face is provided with a flow hole to open a region of the space, wherein the second face includes a plurality of curved portions arranged in a height direction of the heat sink, the curved portions having different radii of curvature, wherein the plurality of curved portions includes a first curved portion and a second curved portion arranged in sequence with increasing distance from the first face and decreasing distance to the flow hole, and wherein the first curved portion and the second curved portion have centers of curvature respectively located at different regions divided on the basis of the second face.

2. The apparatus according to claim 1, wherein the radius of curvature of the first curved portion is less than the radius of curvature of the second curved portion.

3. The apparatus according to claim 2, wherein the first curved portion has a shorter arcuate length than an arcuate length of the second curved portion.

4. The apparatus according to claim 2, wherein air of the space flows outward through the flow hole during operation of the light emitting unit, wherein outside air flows to the flow hole along the second face, and wherein the outside air increases in flow velocity while passing the first curved portion and is reduced in flow velocity while passing the second curved portion.

5. The apparatus according to claim 2, wherein a planar portion is provided between the second curved portion and the flow hole, and wherein the planar portion is parallel to the first face.

6. The apparatus according to claim 2, wherein a vertical portion perpendicular to the first face is provided between the first face and the first curved portion.

7. The apparatus according to claim 2, wherein an inflection point on a boundary between the first curved portion and the second curved portion is positioned so as not to overlap the light emitting unit in the height direction of the heat sink.

8. The apparatus according to claim 1, wherein the space accommodates a plurality of radiation fins having a prescribed height.

9. The apparatus according to claim 8, wherein the respective radiation fins are reduced in height with increasing distance from the flow hole.

10. The apparatus according to claim 1, wherein the flow hole has a greater extension length in a longitudinal direction of the heat sink than an extension length thereof in a width direction of the heat sink.

11. The apparatus according to claim 1, wherein the heat sink has a symmetrical shape on the basis of the flow hole.

12. The apparatus according to claim 8, further comprising a housing configured to surround the power source unit.

13. The apparatus according to claim 12, wherein one or more radiation fins among the radiation fins are provided respectively with mounts for coupling with the housing.

14. The apparatus according to claim 1, wherein the flow hole is configured to extend over a length of the entire second face, and either longitudinal end of the second face is opened by the flow hole.

* * * * *